United States Patent [19]

Ibrahimpasic

[11] Patent Number: 4,480,626

[45] Date of Patent: Nov. 6, 1984

[54] DEVICE FOR DRESSING GRINDING WHEELS

[76] Inventor: Ibrahim Ibrahimpasic, 1566 Scott St., San Jose, Calif. 95126

[21] Appl. No.: 436,071

[22] Filed: Oct. 22, 1982

[51] Int. Cl.[3] ..... B25B 53/00

[52] U.S. Cl. ..... 125/11 DF; 125/11 AS; 125/11 BS; 125/11 GA

[58] Field of Search ..... 51/2 F, 5 D, 262 T; 125/11 R, 11 A, 11 AT, 11 AS, 11 GA, 11 BS, 11 DF, 11 ST, 11 M

[56] References Cited

U.S. PATENT DOCUMENTS

| | | | |
|---|---|---|---|
| 2,311,262 | 2/1943 | Stewart | 125/11 BS |
| 2,405,551 | 8/1946 | Bishop et al. | 125/11 BS |
| 3,263,667 | 8/1966 | Smith | 125/11 R |

FOREIGN PATENT DOCUMENTS

| | | | |
|---|---|---|---|
| 262538 | 7/1913 | Fed. Rep. of Germany | 125/11 GA |
| 2453446 | 5/1976 | Fed. Rep. of Germany | 125/11 DF |
| 403306 | 12/1933 | United Kingdom | 125/11 GA |
| 271329 | 5/1970 | U.S.S.R. | 125/11 AS |

*Primary Examiner*—James G. Smith

*Attorney, Agent, or Firm*—Cantor and Lessler

[57] ABSTRACT

A device for dressing one or both side faces of a circular grinding wheel. The device provides for movement of a dressing tool in an arcuate path across the face of the grinding wheel, and simultaneously, toward and away from the grinding wheel.

12 Claims, 5 Drawing Figures

α
4
26
28
30
66
64
54
68
70
72
58
48
62
60
α
56
4

30
26
28
24
62
82
48
80
78
α

30
26
64
64
D
74
76
76
58

DEVICE FOR DRESSING GRINDING WHEELS

BACKGROUND OF THE INVENTION

This invention relates to dressers for grinding wheels, and more particularly, this invention relates to a device for dressing one or both of the side faces of a circular grinding wheel.

Grinding wheels are commonly used to accurately machine certain types of metal and other objects. But, as is well-known, the grinding surface of a grinding wheel eventually wears to the point where the grinding wheel will no longer provide the accuracy needed. Since grinding wheels are expensive, they are not merely discarded. Rather, they are re-surfaced or dressed.

Many types of dressing devices are known in the prior art, both manual and automatic. Most of the known devices for dressing grinding wheels are designed specifically for dressing the radial or peripheral face of a grinding wheel. Typical of such prior art devices are those disclosed in Nichols U.S. Pat. No. 3,576,184; Espinosa U.S. Pat. No. 4,262,649; Gruber U.S. Pat. No. 4,051,830; Grabowski U.S. Pat. No. 3,372,687; and Newbould U.S. Pat. No. 2,832,329.

But to the best of my knowledge, there are no simple, efficient devices for dressing the side surfaces of a circular grinding wheel. A need, therefore, exists for such a device.

More specifically, the device of the present invention will dress one or both side surfaces of a circular grinding wheel in such a way that the side surface is tapered at a pre-determined angle from the hub outwardly to the periphery.

SUMMARY OF THE INVENTION

It is, therefore, an object of the present invention to provide a grinding wheel dresser which is free of the aforementioned and other such disadvantages.

It is another object of the present invention to provide a dresser for grinding wheels which is accurate and simple to use.

It is yet another object of the present invention to provide a device for dressing one or both side surfaces of a grinding wheel at a pre-determined angle.

It is still another object of the present invention to provide a device for dressing both side surfaces of a grinding wheel simultaneously.

Consistent with the foregoing objects, the present invention provides a device for dressing grinding wheels comprising a base, having at least one pair of spaced-apart upstanding supports, the base being adapted to be disposed on a flat horizontal support surface proximate to said grinding wheel; a holder pivotally mounted between said supports with its pivot axis being in a common vertical plane with the axis of rotation of the grinding wheel; a dressing tool mounted in the holder and protruding therefrom, such that it contacts the side of the grinding wheel; the holder being adapted to pivot such that the dressing tool describes an arc along the side of the grinding wheel from the peripheral edge when said holder is pivoted downwardly, to the region adjacent to the central hub when the holder is disposed essentially vertically; and means for causing the holder, when it is pivoted, to simultaneously move axially toward and away from the wheel.

BRIEF DESCRIPTION OF THE DRAWINGS

The foregoing objects and advantages will be described, and other objects and advantages will become apparent, when consideration is given to the following description of the preferred embodiments which refer to the annexed drawings, wherein.

DESCRIPTION OF THE PREFERRED EMBODIMENT

Figure 1:
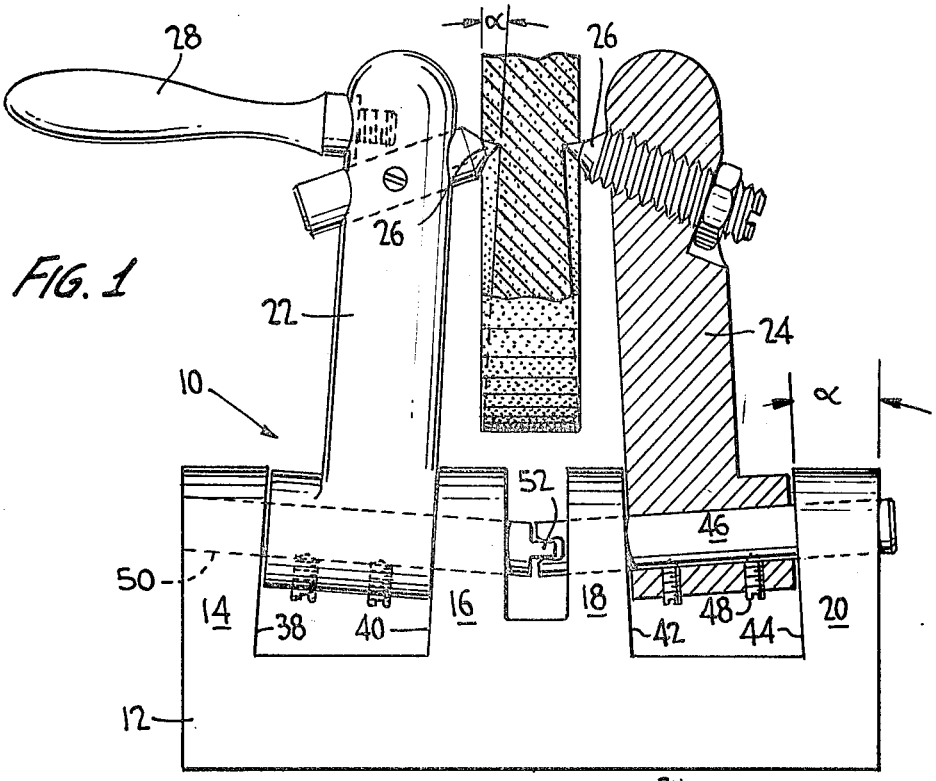
FIG. 1 is a front elevation view, partly in cross-section for illustrative clarity, of one embodiment of the wheel dresser of the present invention.

Referring first to FIG. 1, there is shown a first embodiment of the invention, a device for dressing both side surfaces of a circular grinding wheel simultaneously. The device is generally designated by the numeral 10. The device comprises a base 12, having two pairs of spaced-apart upstanding supports 14, 16, 18, and 20. Two holders, 22 and 24, are pivotally mounted between supports 14 and 16, and supports 18 and 20 respectively. A diamond tip dressing tool, 26, is mounted in each holder, 22 and 24, in the usual manner. Dressing tool 26 may be adjustably mounted as shown in holder 24, or fixed as shown in holder 22. Furthermore, the dressing tool could be a carbide tool or it could be made of any other suitable material known in the art. A handle, 28, is provided at the upper end of holder 24.

Figure 2:
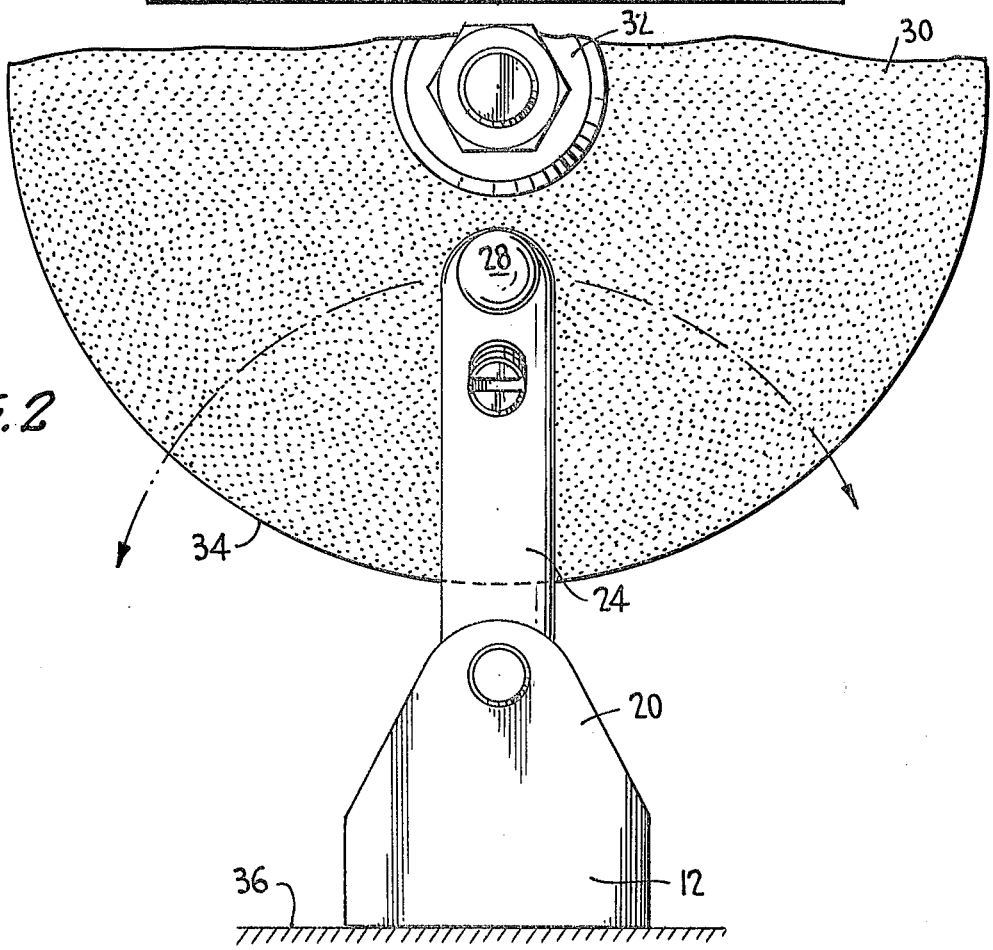
FIG. 2 is a side elevational view of the device of FIG. 1.

Referring to FIG. 2, it will be seen that when the holder 24 is pivoted by moving handle 28, it describes an arc across the face of grinding wheel 30 from an inner central region near the hub 32 out to the peripheral edge 34. Since at the same time, the holder is moving axially away from the grinding wheel 30 as it moves from the central region to the periphery of the wheel, a taper is provided moving outwardly at a predetermined angle $\alpha$ as shown in FIG. 1.

As can be seen from FIGS. 1 and 2, the dressing device 10 is placed with its base 12 on a flat, horizontal surface 36 proximate to the grinding wheel 30. Upstanding supports 14, 16, 18, and 20 extend vertically upwardly, but the opposed inner faces 38 and 40 and 42 and 44, respectively, are at an angle to the vertical equal to the angle $\alpha$. Thus, supports 22 and 24 are each pivoted about an axis which lies in the same vertical plane as the axis of rotation of the grinding wheel 30, but which is not parallel thereto. When holders 22 and 24 are essentially vertical, the diamond dressing tool is closest to the wheel and, therefore, cuts most deeply into the wheel. But, as the holders 22 and 24 are rotated downwardly to one side, they follow the contour of the inner faces of the supports, and therefore, move progressively apart. Thus, the angle which inner faces 38–40 and 42–44 make with the vertical is translated to the angle of taper of the grinding wheel.

Attention is again directed to FIG. 1, wherein the pivotal mounting of the holders 22 and 24 on the supports 14–16 and 18–20, respectively, is shown. Holder 24 is fixed to shaft 46 by means of set screws, or the like, 48. Shaft 46 is mounted for rotation at the desired angle in supports 18 and 20. Similarly, holder 22 is fixed to shaft 50, which in turn, is mounted at the desired angle for rotation in supports 14 and 16. In order to cause shaft 50 to rotate simultaneously with shaft 46, the two shafts are joined through a flexible coupling, or universal joint-type arrangement 52. This flexible coupling 52 provides for transmission of the rotational movement from shaft 46 to shaft 50, while compensating for the difference in axes of rotation.

Figure 3:
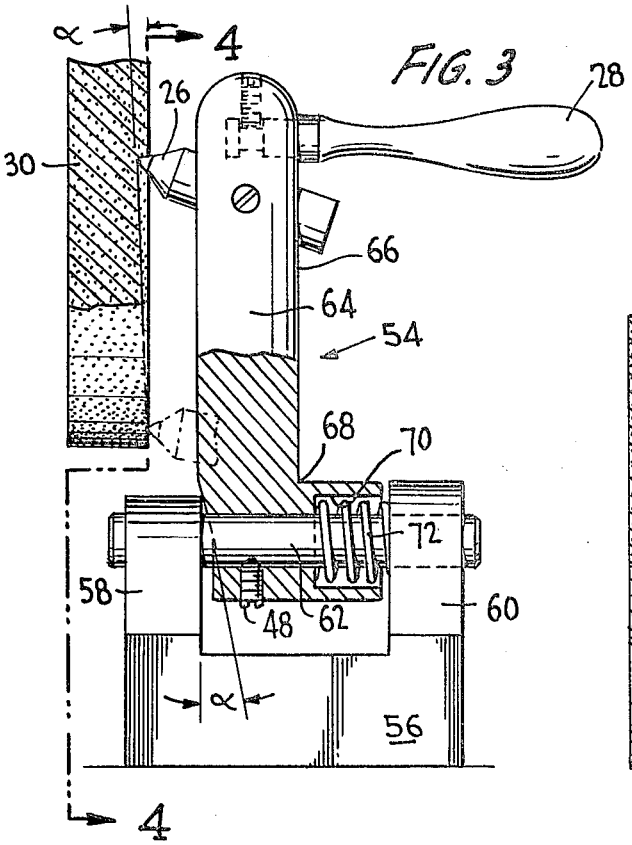
FIG. 3 is a front elevational view partially in cross-section for illustrative clarity, of a second embodiment.

Referring now to FIG. 3, there is shown a wheel dresser generally designated by the numeral 54 for dressing one side of a grinding wheel 30. In this embodiment, there is a base 56 having a single pair of upstanding supports 58 and 60. It will be noted that supports 58 and 60 are vertically upstanding and all four faces are parallel, that is, the inner faces are not angled as in the embodiment of FIG. 1. In this embodiment, the supports 58 and 60 are vertical. Shaft 62 is mounted for rotation in supports 58 and 60 about an axis which is parallel to the axis of rotation of grinding wheel 30. Holder 64 is fixed to shaft 62 by a set screw or the like 48. Holder 64 differs from holder 24 in an important respect. Holder 64 has an upper portion 66 and a lower base portion, 68. The face of lower base portion 68 which contacts support 58 is tapered downwardly at an angle $\alpha$ which is the desired angle of taper for the grinding wheel. It is pointed out that the angle $\alpha$ as illustrated in the drawings is somewhat exagerated for purposes of illustration. The angle, in all the embodiments, is usually between about 2.5° and about 3°, and preferably about 3°.

Figure 4:
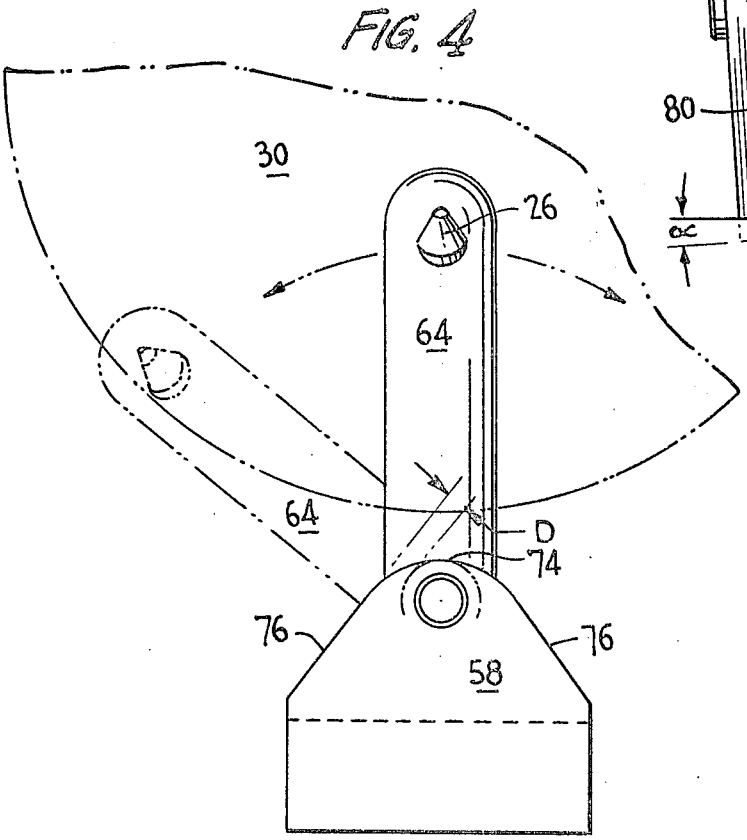
FIG. 4 is a side elevational view of the embodiment of FIG. 3.

The end of base portion 68, which is closest to support 60, has a bore designated 70, and a compression spring 72 which normally biases support 64 to the left, as viewed in FIG. 3. Thus, when holder 64 is rotated through an arc by moving handle 28 from the position shown in solid lines in FIG. 4 to the position shown in phantom in FIG. 4, the diamond dressing tool, 66, moves axially outwardly, thereby imparting the angle of taper, $\alpha$ to the grinding wheel 30.

It can be seen that support 58 is slightly lower than support 60. It will be also be seen that the upper portion 74 of support 58 is arcuate, and merges into straight portions 76. Since the angled lower portion of base portion 68 is urged against support 58 by spring 72, as the holder 64 is rotated, that angled portion rides against portions 74 and 76 of support 58. Due to the difference in thickness of base portion 68 at its bottom end from its top end, holder 64 actually moves axially a distance D shown if FIG. 4.

Figure 5:
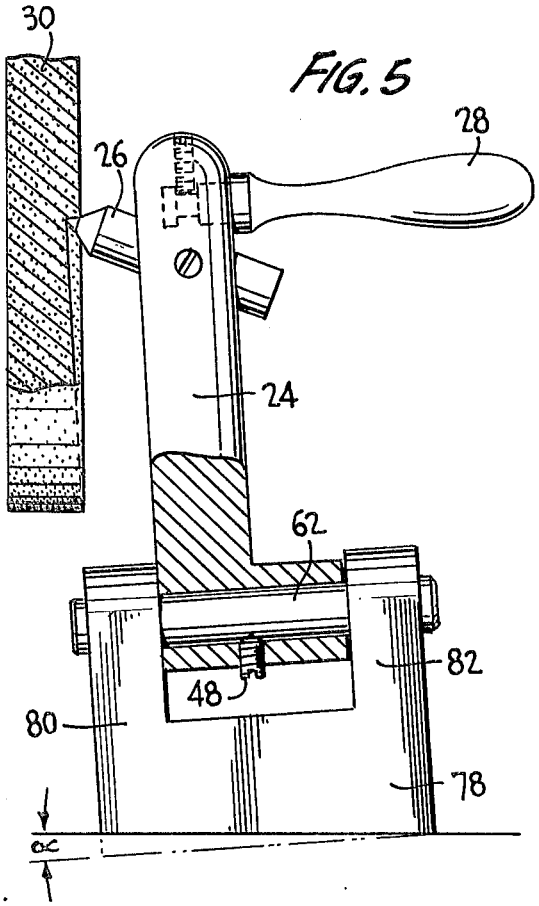
FIG. 5 is a front elevational view, partly in cross-section for illustrative purposes, of a third embodiment.

In a third embodiment illustrated in FIG. 5, the bottom surface of base 78 is made at an angle $\alpha$ to the horizontal. Supports 80 and 82 are upstanding at right angles to the base, and are, therefore, tilted toward the grinding wheel 30 at the same angle. Holder 24 is identical to the holder in the first embodiment.

Thus, it can be seen that the objects set forth at the beginning of this specification have been successfully achieved. Since many embodiments may be made of the instant inventive concepts, and many modifications may be made of the embodiments herein before described, it is to be understood that all matter herein is to be interpreted merely as illustrative and not in a limiting sense, the invention being limited only by the scope of the following claims.

What is claimed is:

1. A device for dressing grinding wheels comprising:

(A) A base having two pairs of spaced-apart upstanding supports, each support of each pair having a surface facing the other support, said base being adapted to be disposed on a flat, horizontal support surface, proximate to said grinding wheel;

(B) A holder pivotally mounted between each pair of supports with its pivot axis being in a common vertical plane with the axis of rotation of said grinding wheel;

(C) A dressing tool mounted in each said holder and protruding therefrom such that said dressing tool contacts the side of said grinding wheel;

(D) Said holders being adapted to pivot such that said dressing tools describe an arc along said side of said grinding wheel from the peripheral edge, when said holders are pivoted downwardly, to the region adjacent to the central hub, when said holders are disposed essentially vertically;

(E) The facing surfaces of each said pair of supports being tilted toward said grinding wheel by a predetermined angle from the vertical corresponding to the desired dressing angle of the grinding wheel whereby said holders, when they are pivoted, simultaneously move axially toward and away from said wheel; and (F) Said pairs of holders being so spaced apart that they can receive said grinding wheel between them, whereby both sides of said grinding wheel may be dressed simultaneously.

2. A device according to claim 1, wherein said holders are connected through a flexible linkage, whereby pivotal movement of one said holder will cause the other said holder to pivot.

3. A device as claimed in claim 1, wherein said angle is from about 2.5° to about 3°.

4. A device for dressing grinding wheels comprising:

(A) A base having two pairs of spaced-apart upstanding supports, each support of each pair having a surface facing the other support, said base being adapted to be disposed on a flat, horizontal support surface, proximate to said grinding wheel;

(B) A holder pivotally mounted between each pair of supports with its pivot axis being in a common vertical plane with the axis of rotation of said grinding wheel;

(C) A dressing tool mounted in each said holder and protruding therefrom such that said dressing tool contacts the side of said grinding wheel;

(D) Said holders being adapted to pivot such that said dressing tools describe an arc along said side of said grinding wheel from the peripheral edge, when said holders are pivoted downwardly, to the region adjacent to the central hub, when said holders are disposed essentially vertically;

(E) means for causing said holder, when it is pivoted, to simultaneously move axially toward and away from said wheel;

(F) Said pairs of holders being so spaced apart that they can receive said grinding wheel between them, whereby both sides of said grinding wheel may be dressed simultaneously;

(G) Each support has a through bore perpendicular to the facing surfaces of each said pair of supports; each holder has a base portion and a holder portion perpendicular thereto and extending radially outwardly therefrom, and an axial through bore in said base portion; and said device further comprises pivot means being pivotally mounted in said firstmentioned bores, said holder being fixed to said pivot means.

5. A device as claimed in claim 4, wherein said facing surfaces of each said pair of supports is tilted toward said grinding wheel by a predetermined angle from the vertical corresponding to the desired dressing angle of the grinding wheel.

6. A device as claimed in claim 5, wherein said angle is from about 2.5° to about 3°.

7. A device as claimed in claim 4, wherein each said pivot means is a shaft and the two shafts are joined by a flexible linkage.

8. A device according to claim 4, wherein said holders are connected through a flexible linkage, whereby pivotal movement of one said holder will cause the other said holder to pivot.

9. A device for dressing grinding wheels comprising:

(A) A base having one pair of spaced-apart upstanding supports extending perpendicularly upwardly therefrom, said base being adapted to be disposed on a flat, horizontal support surface, proximate to said grinding wheel;

(B) A holder pivotally mounted between said supports with its pivot axis being in a common vertical plane with the axis of rotation of said grinding wheel;

(C) Said supports having coaxial through bores the axes of which constitute said pivot axis, each of said supports having an arcuate upper surface and essentially straight downwardly diverging sides;

(D) A shaft pivotally mounted in said bores for axial movement; said said holder having a base portion and a holder portion extending perpendicular thereto, said base portion having a through bore and being fixed to said shaft, said base portion at its upper portion, having an axial thickness approximately equal to the distance between said supports and being tapered downwardly away from the vertical on the side nearer the grinding wheel, at an angle equal to the desired dressing angle of the wheel, and said base portion being biased toward the support closer to the grinding wheel;

(E) A dressing tool mounted in said holder and protruding therefrom such that said dressing tool contacts the side of said grinding wheel;

(F) Whereby said dressing tool describes an arc along said side of said grinding wheel from the peripheral edge, when said holder is pivoted downwardly, to the region adjacent to the central hub, when said holder is disposed essentially vertically; and (G) Whereby, said holder, when it is pivoted, simultaneously moves axially toward and away from said wheel.

10. A device as claimed in claim 9, wherein said angle of taper is from about 2.5° to about 3°.

11. A device for dressing grinding wheels comprising:

(A) A base having a pair of spaced-apart upstanding parallel supports perpendicular thereto, said base being adapted to be disposed on a flat, horizontal support surface, proximate to said grinding wheel;

(B) A holder pivotally mounted between said supports with it pivot axis being in a common vertical plane with the axis of rotation of said grinding wheel;

(C) A dressing tool mounted in said holder and protruding therefrom such that said dressing tool contacts the side of said grinding wheel;

(D) Said holder being adapted to pivot such that said dressing tool describes an arc along said side of said grinding wheel from the peripheral edge, when said holder is pivoted downwardly, to the region adjacent to the central hub, when said holder is disposed essentially vertically; and (E) The bottom surface of said base being tapered to lean toward said grinding wheel at an angle equal to the desired dressing angle of the grinding wheel, whereby said holder, when it is pivoted, simultaneously moves axially toward and away from said wheel.

12. A device as claimed in claim 11, wherein said angle is from about 2.5° to about 3°.

* * * * *